US007200883B2

(12) United States Patent
Haggerty

(10) Patent No.: US 7,200,883 B2
(45) Date of Patent: Apr. 10, 2007

(54) BI-SECTIONAL BEDDING MATERIAL

(75) Inventor: David W. Haggerty, 1432 N. Woodlawn, Tacoma, WA (US) 98406

(73) Assignee: David W. Haggerty, Tocoma, WA (US)

( * ) Notice: Subject to any disclaimer, the term of this patent is extended or adjusted under 35 U.S.C. 154(b) by 0 days.

(21) Appl. No.: 11/147,142

(22) Filed: Jun. 7, 2005

(65) Prior Publication Data

US 2006/0059622 A1 Mar. 23, 2006

Related U.S. Application Data

(60) Provisional application No. 60/577,711, filed on Jun. 7, 2004, provisional application No. 60/658,663, filed on Mar. 3, 2005.

(51) Int. Cl.
*A47G 9/02* (2006.01)

(52) U.S. Cl. ..... 5/486; 5/482

(58) Field of Classification Search ..... 5/486, 5/502, 482, 500
See application file for complete search history.

(56) References Cited

U.S. PATENT DOCUMENTS

| | | | | |
|---|---|---|---|---|
| 1,267,042 | A | 5/1918 | Arnold | |
| 2,689,961 | A | 9/1954 | Lieberthal | |
| 2,695,414 | A | 11/1954 | Ford et al. | |
| 2,730,728 | A | 1/1956 | Roberts | |
| 3,072,776 | A * | 1/1963 | Quenneville | 219/212 |
| 3,331,088 | A | 7/1967 | Marquette | |
| 3,508,285 | A | 4/1970 | Marquette | |
| 3,530,516 | A * | 9/1970 | Marquette | 5/486 |
| 4,384,380 | A * | 5/1983 | Glaha et al. | 5/485 |
| 4,573,227 | A | 3/1986 | Prandina | |
| 4,802,251 | A * | 2/1989 | O'Dell | 5/502 |
| 5,201,086 | A | 4/1993 | Decker | |
| 5,287,573 | A * | 2/1994 | Ritacco | 5/486 |
| D379,893 | S | 6/1997 | Dilbeck | |
| 5,943,717 | A | 8/1999 | Alexander | |
| 6,122,781 | A | 9/2000 | Stephenson | |
| 6,226,814 | B1 | 5/2001 | Alexander | |
| 6,311,347 | B1 | 11/2001 | Limardi et al. | |
| 6,341,396 | B1 | 1/2002 | Carapezza | |
| 6,643,872 | B1 * | 11/2003 | Buswell | 5/486 |
| 2003/0217411 | A1 | 11/2003 | Bradley et al. | |
| 2005/0268399 | A1 * | 12/2005 | Demarco et al. | 5/486 |

* cited by examiner

*Primary Examiner*—Alexander Grosz
(74) *Attorney, Agent, or Firm*—Black Lowe & Graham PLLC

(57) ABSTRACT

A bedding system comprising a fitted sheet having two sections, each section made of a different fabric and a flat sheet having two sections each section being of a different fabric such that the different materials cause different warming characteristics.

10 Claims, 5 Drawing Sheets

BI-SECTIONAL BEDDING MATERIAL

PRIORITY CLAIM

This application claims priority to U.S. Provisional Patent Application Ser. No. 60/577,711 filed Jun. 7, 2004 and U.S. Provisional Patent Application Ser. No. 60/658,663 filed Mar. 3, 2005. Each and all of the foregoing applications are incorporated by reference as if fully set forth herein.

FIELD OF THE INVENTION

This invention relates to bedding material.

BACKGROUND OF THE INVENTION

Bedding material particularly sheets applied to beds are made of single composition fabrics. The single composition fabrics have only a specific type of heating characteristics to the bed occupants. The heating characteristics have a rate of heating that may be too rapid to one bed occupant to that of another. There is a need for bedding materials that provide differential warming characteristics or feeling of rate of warming to different bed occupants.

SUMMARY OF THE INVENTION

Preferred and particular embodiments include bi-sectional sheets that either fit to a bed mattress or are overlaid over the bed mattress wherein each section is made from a different fabric having different warming characteristics. One particular embodiment is a bottom or fitted bed sheet having at least two sections, one section having a fabric that is different from the other section's fabric. In a particular embodiment of the fitted sheet, one section for example is cotton, the other section is polar fleece. In the fitted sheet embodiment, the cotton and polar fleece sections are sewn together in the middle of the bi-sectional bed sheet. Other particular embodiments of the fitted bed sheet include slits at the depth ends of the fitted sheet, particularly in the head-end and the toe-end. The slits at the head and toe-end of the fitted bi-sectional sheets provide a gap the spacing of which imparts greater flexibility for making or applying the fitted sheet to the mattress.

Other embodiments of the multi-sectional bedding material is a top sheet similarly comprising a bi-sectional arrangement of different materials in each section. The top sheet overlays the fitted sheet and is separately applied to the mattress. Embodiments of the top sheet include different arrangements of slits advantageously placed to provide different use options to the bed occupants. In one particular embodiment of the top sheet, partial splits are placed at the head and toe-ends of the sheets to allow for improved flexibility in tucking in at the toe-end as well as to provide the head-end of the sheets may be independently folded as desired by the bed occupants. In a particular embodiment of the top sheet, the one section is cotton and the other section is polar fleece with a pillow or head-end slit of approximately 10% the length of the top sheet and a comparable 10% split at the toe-end of top sheet, leaving approximately 80% of a sewn stitch uniting the cotton and polar fleece bi-sections.

Another embodiment of the top sheet includes a middle slit and stitched ends. The stitched ends occupy approximately 20% the length of the top sheet where 10% is stitched at the head-end of the top sheet and 10% stitched at the toe-end of the top sheet, leaving pillow 80% of an open slit between the cotton and polar fleece bi-sections. The slit in the middle of the flat top sheet permits flexibility for the bed occupants to move their arms or legs through the slit opening for cooling or other reasons.

Another embodiment of the bi-sectional bedding material includes a bi-sectional flat or top sheet that is sewn to the fitted or bottom bi-sectional sheet. Each fitted, flat, bottom, and top bi-sectional sheets have sections composed of different fabrics. For example, cotton and polar fleece. The combination of stitched flat and fitted bi-sectional sheets advantageously provide for a single bed-making operation. A particular embodiment of the toe-end stitched flat to fitted bi-sectional sheets includes the top sheet having a slit at the head-end of approximately 10% of the length of the top sheet, leaving approximately 90% of the top sheet being seam stitched thereby uniting the cotton and polar fleece fabric sections.

BRIEF DESCRIPTION OF THE DRAWINGS

Preferred and alternative embodiments of the present invention are described in detail below with reference to the following drawings.

DETAILED DESCRIPTION OF THE PREFERRED EMBODIMENT

Figure 1:
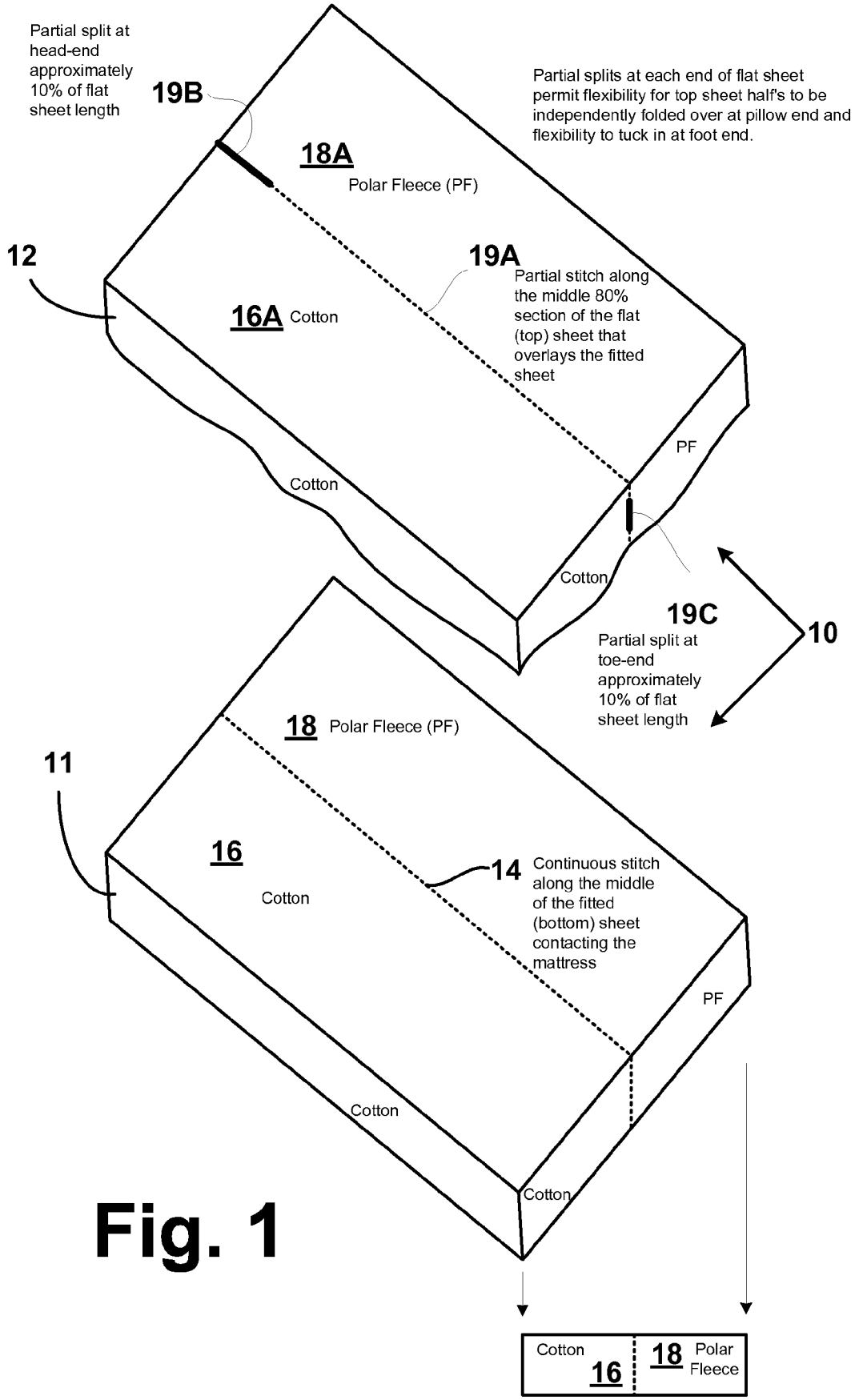
FIG. 1 is an isometric view of a bi-sectional flat sheet having head and toe slits adjacent to a bi-sectional fitted sheet.

FIG. 1 is an isometric view of a hi-sectional flat sheet having head and toe slits adjacent to a bi-sectional fitted sheet. Also shown in FIG. 1 is a projected side view of the fitted sheet. FIG. 1 illustrates a fitted sheet/flat sheet combination 10 where each fitted and flat sheet are comprised of two fabric sections. As shown, the fitted sheet 11 comprises a cotton section 16 and a polar fleece section 18. Uniting the cotton section 16 and the polar fleece section 18 is a continuous stitch 14 that is continuous along the approximate middle of the fitted sheet 11. The fitted sheet 11 is applied to the mattress bed. The combination bedding material 10 also includes a fiat sheet 12. The flat sheet 12 similarly has a cotton 16A and a polar fleece 18A. The fabric bi-sections 16A and 16B are united together via a partial stitch 19A. The partial stitch 19A occupies approximately the middle 80% of the length of the flat sheet 12 and is approximately along the centerline of the flat sheet 12. On either side of the partial stitch 19A are partial splits 19B and 19C. Partial split 19B is located along the pillow or head-end of the flat sheet 12 and partial split 19C is located at the toe-end of the flat sheet 12. Partial splits 19B and 19C are approximately 10% of the length of the flat sheet 12. The partial splits at each end of the sheet permit flexibility for the top sheet fabric bi-sections 16A and 18A to be independently folded over at the pillow end and further provides flexibility for tucking in under the mattress at the toe-end of the flat sheet 12.

Figure 2:
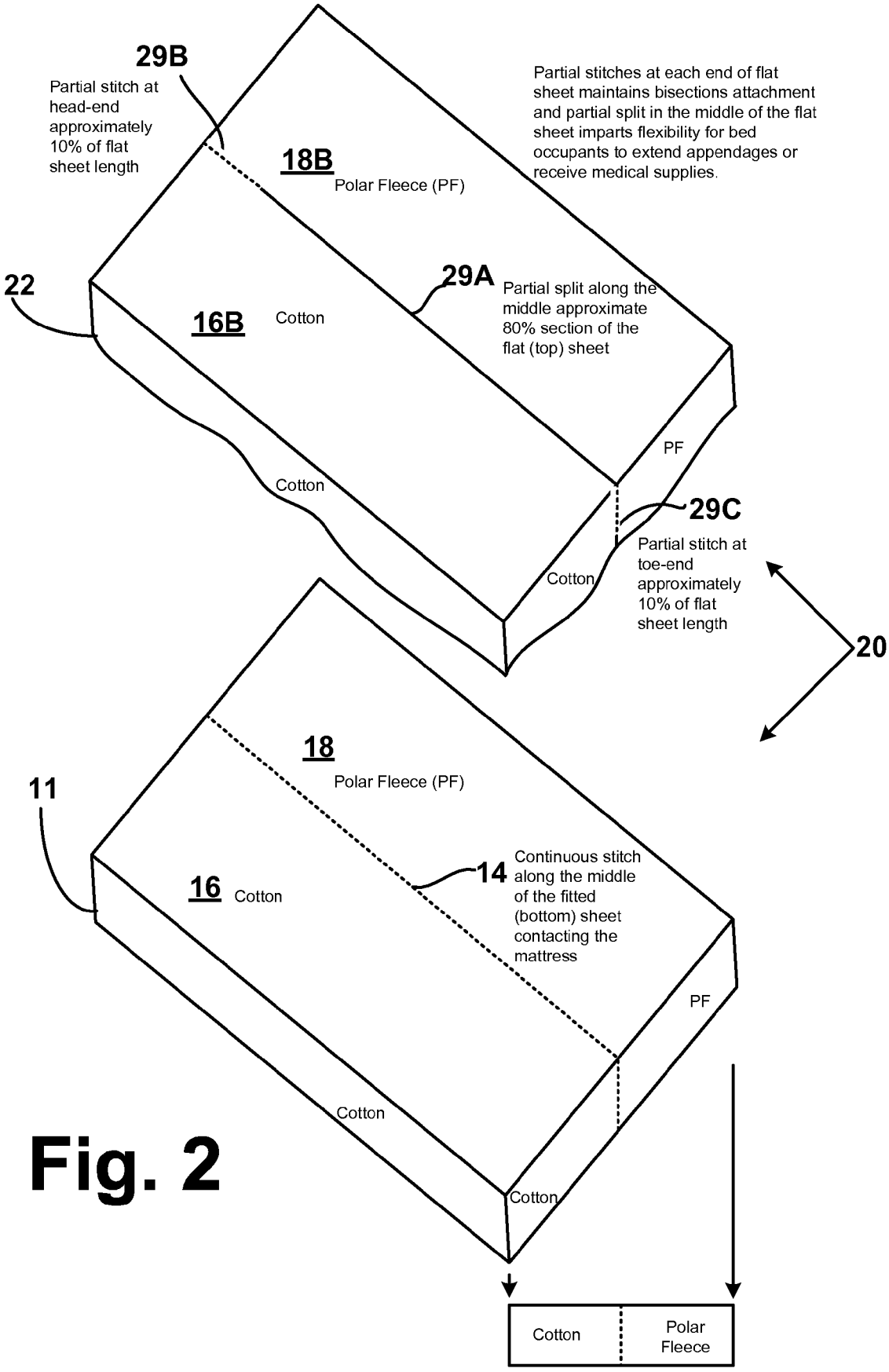
FIG. 2 is an isometric view of a bi-sectional flat sheet having head and toe stitches adjacent to a bi-sectional fitted sheet.

FIG. 2 is an isometric and side view of a bedding material system 20. The bedding material system 20 includes the fitted sheet 11 as previously described from FIG. 1 and a flat sheet 22. The flat sheet 22 includes a cotton fabric section 16B and the polar fleece section 18B. Along the center line of the flat sheet 22 is a series of partial stitches and a partial split. Disposed approximately along the middle 80% section of the centerline of the flat sheet 22 is a partial split 29A. Bracketing either side of the partial split 29A are partial stitches 29B and 29C. The partial stitches 29B and 29C are approximately 10% of the flat sheet length. Partial stitch 29B is located at the head-end of the flat sheet 22 and partial stitch 29C is located at the toe-end of the flat sheet 22. The partial stitches 29B and 29C at each end of the flat 22 maintains the attachment of the cotton bi-section 16B and the polar fleece bi-section 18B. The partial split 29A located in the approximate middle 80% of the flat sheet 22 provides flexibility to the bed occupants to extend appendages through or to receive medical devices.

Figure 3:
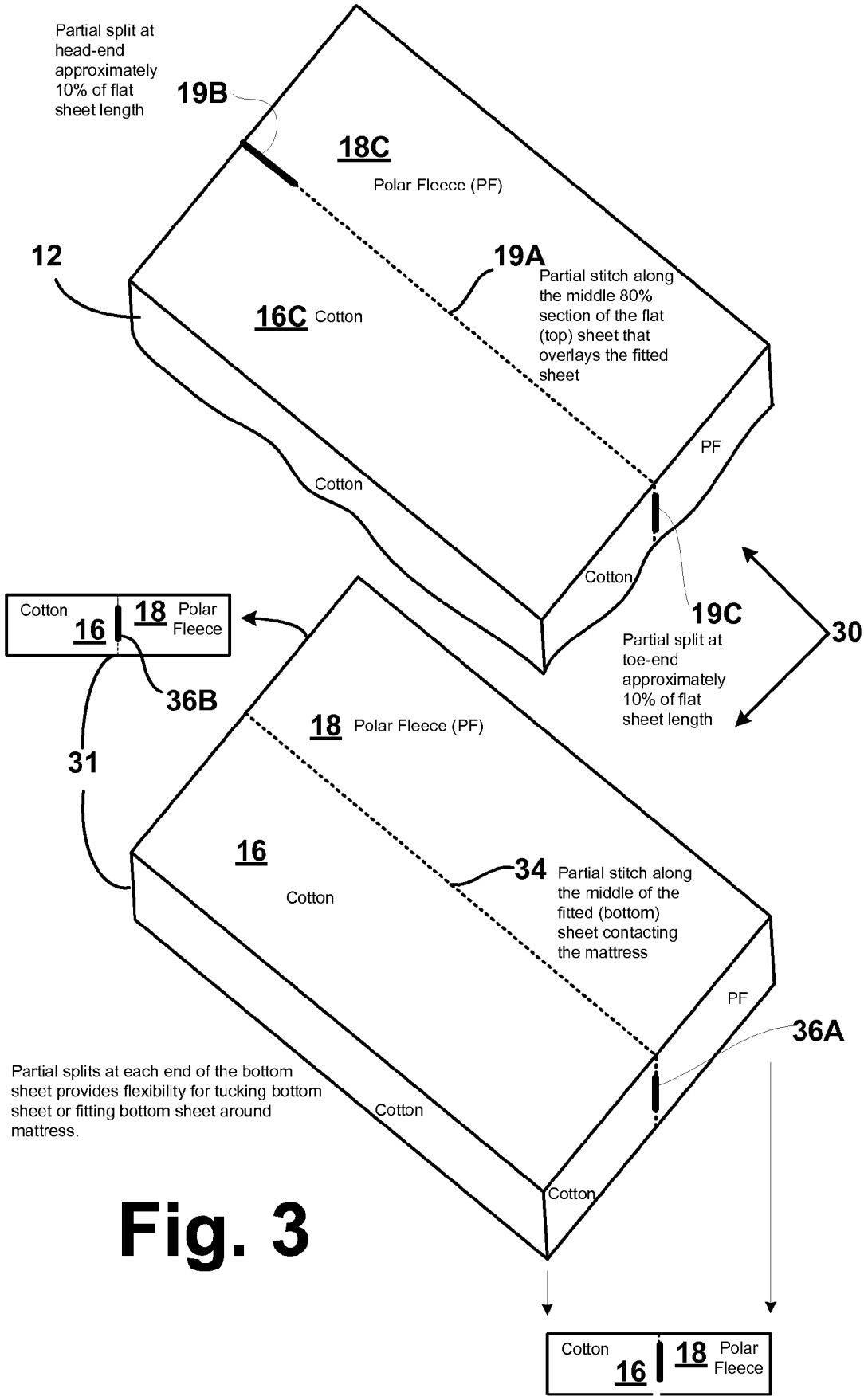
FIG. 3 is an isometric view of a bi-sectional flat sheet having head and toe slits adjacent to a bi-sectional fitted sheet having head and toe splits.

FIG. 3 is an isometric and side view of a bedding system 30. The bedding system 30 includes a flat sheet 12 as previously described from FIG. 1 and a fitted bottom sheet 31. The fitted bottom sheet 31 includes a cotton fabric bi-section 16C and a polar fleece fabric bi-section 18C which are seamed together via a partial stitch 34 along the middle approximate 80% of the center line via a partial stitch 34. Located on each side of the partial stitch 34, are partial splits 36A and 36B. Partial splits 36A is located at the toe-end of the mattress and partial split 36B is located at the head-end of the mattress of the fitted sheet 31. The partial splits at each end of the fitted sheet 31 provide flexibility for tucking the flat sheet or otherwise fitting the flat sheet around the mattress.

Figure 4:
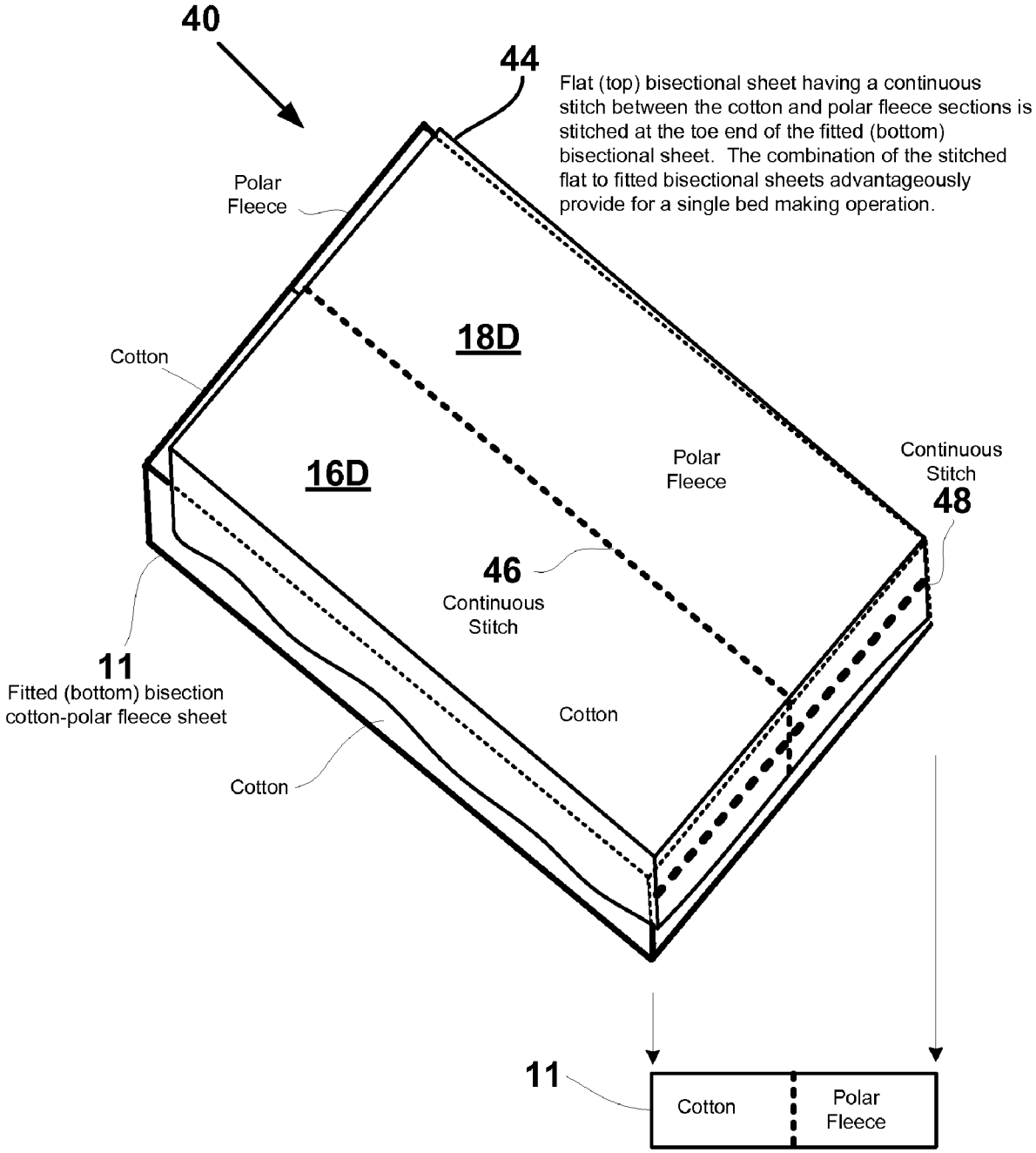
FIG. 4 is a bi-sectional flat sheet stitched to the toe-end of a bi-sectional fitted sheet.

FIG. 4 is an isometric view of a bedding system 40. The bedding system 40 includes a bi-sectional flat sheet 44 stitched to at the toe-end of a fitted sheet 11. Alternatively, the bi-sectional flat sheet 44 may be stitched the toe-end of a fitted sheet 31. The bi-sectional flat sheet 44 includes cotton fabric bi-section 16D and polar fleece fabric bi-section 18D, each bi-section being seamed together via a continuous stitch 46 that runs the length of the flat bi-section sheet 44. The bedding system 40 advantageously provides for a single bed-making operation in that the bi-sectional flat sheet 44 is seamed to the fitted sheet 11 via a continuous stitch 48. Such an arrangement provides for a one bed-making operation to the mattress. Thus, the bedding system 40 is polarized in a sense that, for example, the cotton section is on the left side of the bed and the polar fleece section is on the right side of the bed. Other embodiments would allow for the respective cotton and polar fleece fabric sections 16D and 18D to be switched so that the cotton section would be on the right side of the bed and the polar fleece section would be on the left side of the bed. Yet further embodiments would include the fitted sheet 11 to have the cotton bi-section 16D on the left, the polar fleece fabric section 18D on the right, and the bi-sectional top sheet 44 having the polar fleece fabric section on the left, and the cotton fabric section 16D on the right. In the proceeding embodiment, this would mean that the cotton fabric section 16D of the fitted sheet would be opposing the polar fleece fabric section 18D of the flat sheet 44. Similarly, in this switched around arrangement, the polar fleece fabric section 18 of the fitted sheet 11 would be opposing the cotton fabric section 16D of the flat sheet 44.

Figure 5:
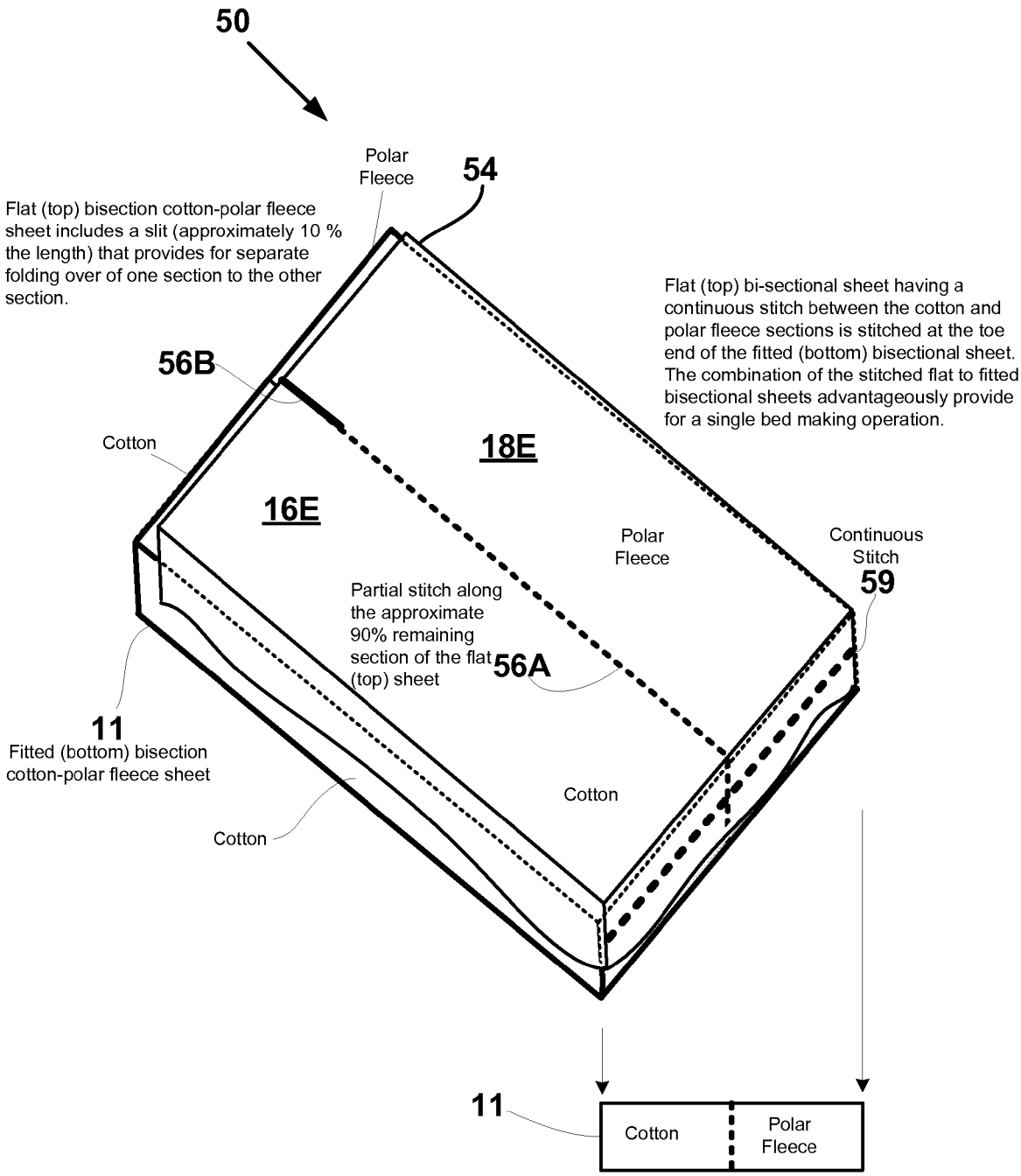
FIG. 5 is a bi-sectional sheet having a head-end split and the toe-end being stitched to a bi-sectional fitted sheet.

FIG. 5 is an isometric and cross-sectional view of a bi-sectional flat sheet stitched to the toe-end of a bi-sectional fitted sheet. FIG. 5 shows a bedding system 50 that includes a fitted sheet 11 as described in FIG. 1, and a flat sheet 54. Both the fitted sheet 11 and flat sheet 54 are bi-sectional in that they include a cotton fabric section 16E and a polar fleece section 18E. The fitted sheet 54 is similar to the fitted sheet 44 of FIG. 4 with the exception that the head or pillow end of the flat sheet 54 is a partial stitch 56A that seams together the cotton fabric section 16E and the polar fleece section 18E along approximately 90% of the length of the flat sheet 54. Adjacent to and at the head-end of the flat sheet 54 is a partial slit or partial split 58B. The partial slit or partial split 58B serves the same purpose as the partial split 19B of FIG. 1 in that it provides for independent folding over of the respective cotton fabric section 16E and polar fleece fabric sections 18E from one another. As shown in FIG. 5, the flat sheet 54 is seamed to the fitted sheet 11 by a continuous stitch 59. As with the bedding material system 40, the bedding material system 50 advantageously provides for a single bed-making operation in that the flat and fitted sheets 54 and 11 are simultaneously applied to the mattress. As shown in FIG. 5, the bedding material system 50 results in a cotton section 16E being located on the left side of the bed and a polar fleece section on the right side of the bed. In this arrangement, bed occupants are cocooned in either a cotton-to-cotton opposing section or polar fleece-to-polar fleece opposing sections of the fitted and flat sheets 11 and 54. As previously described for FIG. 4, the bedding system 50 may be so configured that the polar fleece sections are on the left and the cotton sections are on the right. In addition, as described in FIG. 4, similarly for FIG. 5, there can be a hybrid combination in which the flat sheet 54 has the polar fleece section opposing the cotton section of fitted sheet 11 and the cotton section of flat sheet 54 opposing the polar fleece section of fitted sheet 11.

Other embodiments for the bedding systems 40 and 50 also would allow for the stitching of the respective flat sheets 44 or 54 to be stitched to other embodiments of the fitted sheet particularly fitted sheet 31. Yet other embodiments of the flat sheets 44 or 54 may be configured similarly to the flat sheet 22 wherein there is a partial slit as shown in 29A and a partial stitch at the head as shown in 29B.

The embodiments as described in FIGS. 1–5 are applied to king size, queen size, and full size beds. The dimensions of a king size bed are approximately for the fitted sheet 78"×80"×18". For the flat sheet about 108"×102" wherein 78" are sewn, 24" are split roughly 12" on the head and 12" on the foot. For the dimensions of the queen size, the fitted sheet has an approximate dimension of 60"×80"×18" and the flat sheet 90"×102". For the flat sheet queen size 78" are sewn and 24" are split with 12" on the head and 12" on the foot. The dimensions for the full size are fitted sheet approximately 60"×80"×18" and for the flat sheet 88"×102". For the flat sheet 78" are sewn, 24" are split with 12" of those being for the head and 12" for the foot. The preceding king, queen, and full sizes are applicable to the preceding FIGURES.

Dimensions that are more particular to the preceding embodiments are discussed below. The pillows are constructed of two bi-sections, wherein one bi-section, for example cotton, is located on one side of the pillow, and the other bi-section, for example polar fleece, is located on the other side of the pillow.

FIG. 1

Approximate Dimensions of the King-Size

Flat Sheet: 108"×102" (78" are sewn, 24" split, 12" on head, 12" on foot) Fitted Sheet: 78"×80"×18" deep 3 Pillowcases: 20"×40"

Approximate Dimensions of the Queen-Size

Flat Sheet: 90"×102" (78" are sewn, 24" split, 12" on head, 12" on foot) Fitted Sheet: 60"×80"×18" deep 2 Pillowcases: 20"×32"

Approximate Dimensions of the Full-Size

Flat Sheet: 88"×102" (78" are sewn, 24" split, 12" on head, 12" on foot) Fitted sheet: 60"×80"×18" deep 2 Pillowcases: 20"×32"

FIG. 2

Approximate Dimensions of the King-Size

Flat Sheet: 108"×102" (24" are sewn, 12" on head, 12" on foot 78" split) Fitted Sheet: 78"×80"×18" deep 3 Pillowcases: 20"×40"

Approximate Dimensions of the Queen-Size

Flat Sheet: 90"×102" (24" are sewn, 12" on head, 12" on foot 78" split) Fitted Sheet: 60"×80"×18" deep 2 Pillowcases: 20"×32"

Approximate Dimensions of the Full-Size

Flat Sheet: 88"×102" (24" are sewn, 12" on head, 12" on foot 78" split) Fitted sheet: 60"×80"×18" deep 2 Pillowcases: 20"×32"

FIG. 3

Dimensions of the King-Size

Flat Sheet: 108"×102"

Fitted Sheet: 78"×80"×18" deep (Measuring from the bottom up on the pockets at the head and foot of the fitted sheet is split 12". The remainder of the 18' deep pocket is sewn 6" which continues through to the opposite end 92")

3 Pillowcases: 20"×40"

Dimensions of the Queen-Size

Flat Sheet: 90"×102"

Fitted Sheet: 60"×80"×18" deep (Measuring from the bottom up on the pockets at the head and foot of the fitted sheet is split 12". The remainder of the 18" deep pocket is sewn 6" which continues through to the opposite end 92")

2 Pillowcases: 20"×32"

Dimensions of the Full-Size

Flat Sheet: 88"×102"

Fitted sheet: 60"×80"×18" deep (Measuring from the bottom up on the pockets at the head and foot of the fitted sheet is split 12". The remainder of the 18' deep pocket is sewn 6" which continues through to the opposite end 92")

2 Pillowcases: 20"×32"

FIGS. 4 and 5

Similar dimensions as FIGS. 1–3, head split being approximately 12 inches.

While the preferred embodiment of the invention has been illustrated and described, as noted above, many changes can be made without departing from the spirit and scope of the invention. For example, the flat and fitted sheets, either separately or in combination, may be applied to the mattress such that the orientation of the seam between the bi-sections of the sheets is approximately 90 degrees to the head and toe axis of the mattress. Each bi-section occupies approximately 50% the mattress area, for example, the upper or head bi-section region is cotton, and the lower or toe-end bi-section region is polar fleece. Other percent area bi-sectional areas are possible, for example, the lower third bi-section is polar fleece, and the upper two-third bi-section is cotton. Alternate embodiments further include fabric bi-sections other than cotton and polar fleece. For example, bi-sections 16 and 18 may respectively be made from silk and flannel fabrics. Accordingly, the scope of the invention is not limited by the disclosure of the preferred embodiment. Instead, the invention should be determined entirely by reference to the claims that follow.

The invention claimed is:

1. A bedding sheet pair (20) comprising:

a fitted sheet (11) having a first fabric section (16) and a second fabric section (18) stitched (14) to the first fabric (16) section, the second fabric section (18) comprising a different material from the first fabric section (16);

a flat sheet (22) having a third fabric section (16B) and a fourth fabric section (18B) stitched to the third fabric section (18B), the third fabric section (18B) comprising a material different from the fourth fabric section (16B);

a head-end partial stitch 29B and a toe-end partial stitch 29C located on the flat sheet (22); and a partial split (29A) located between the head-end partial stitch 29B and toe-end partial stitch 29C of the flat sheet (22).

2. The bedding sheet pair (20) of claim 1 wherein the partial split (29A) of the flat sheet (22) is approximately 80% of the length of the flat sheet (22).

3. The bedding sheet pair (20) of claim 1 wherein the head-end partial stitch 29B of the flat sheet is approximately 10% of the length of the flat sheet (22).

4. The bedding sheet pair (20) of claim 1 wherein the first fabric section 16 and the third fabric section (16B) is made from cotton, and the second fabric section (18) and the fourth fabric sections (18B) is made from polar fleece.

5. A bedding system (20) comprising:

a fitted sheet (11) having at least two bi-sections (16 and 18), each bi-section (16 and 18) having different materials connected by a seam 14;

a flat sheet (22) having two partial seams, a head-end partial seam (29B) and a toe-end partial seam (29C) connecting two bi-sections (16B and 18B), each bi-section (16B and 18B) being made of different materials, and a partial split (29A) located between the head-end and toe-end partial seams (29B and 29C) of the flat sheet (22), wherein the fitted sheet (11) is applied to a mattress and the flat sheet (22) is applied to the fitted sheet (11).

6. The bedding system (20) of claim 5, wherein the the partial split (29A) occupies approximately 80% of the length of the flat sheet (22).

7. The bedding system (20) of claim 6, wherein the head-end partial seam (29B) and the toe-end partial seam (29C) of the flat sheet (22) collectively occupy approximately 20% of the length of the flat sheet (22).

8. The bedding system (20) of claim 5 wherein the different materials include cotton fabric and polar fleece fabric.

9. The bedding system (20) of claim 8, wherein the fitted sheet (11) is applied to the mattress such that cotton fabric of the fitted sheet (22) opposes the cotton fabric of the flat sheet (22).

10. The bedding system (20) of claim 8, wherein the fitted sheet (11) is applied to the mattress such that the cotton fabric of the fitted sheet (11) opposes the polar fleece fabric of the flat sheet (22).

* * * * *